US009194023B2

(12) United States Patent
Wang et al.

(10) Patent No.: US 9,194,023 B2
(45) Date of Patent: Nov. 24, 2015

(54) RECOVERY OF GOLD FROM ROASTER CALCINE LEACH TAILINGS

(71) Applicant: Barrick Gold Corporation, Toronto (CA)

(72) Inventors: Qiankun Wang, Pitt Meadows (CA); Nathan Stubina, Oakville (CA); Wayne Douglas, Spring Creek, NV (US); Todd Esplin, Spring Creek, NV (US); Jodi Esplin, Spring Creek, NV (US); Sajan Bhakta, Elko, NV (US)

(73) Assignee: Barrick Gold Corporation, Toronto (CA)

( * ) Notice: Subject to any disclaimer, the term of this patent is extended or adjusted under 35 U.S.C. 154(b) by 77 days.

(21) Appl. No.: 14/061,354

(22) Filed: Oct. 23, 2013

(65) Prior Publication Data

US 2014/0112823 A1 Apr. 24, 2014

Related U.S. Application Data

(60) Provisional application No. 61/717,405, filed on Oct. 23, 2012, provisional application No. 61/730,860, filed on Nov. 28, 2012.

(51) Int. Cl.

| | |
|---|---|
| ***C22B 11/00*** | (2006.01) |
| ***C22B 3/44*** | (2006.01) |
| ***C22B 1/02*** | (2006.01) |
| ***C22B 3/06*** | (2006.01) |
| ***C22B 3/00*** | (2006.01) |
| ***C22C 5/02*** | (2006.01) |
| *C22C 5/06* | (2006.01) |

(52) U.S. Cl.

CPC . *C22B 11/04* (2013.01); *C22B 1/02* (2013.01); *C22B 3/06* (2013.01); *C22B 3/44* (2013.01); *C22C 5/02* (2013.01); *C22C 5/06* (2013.01)

(58) Field of Classification Search

CPC ..... C22B 3/06; C22B 3/44; C22B 1/02; C22B 11/04

See application file for complete search history.

(56) References Cited

U.S. PATENT DOCUMENTS

| | | | | |
|---|---|---|---|---|
| 4,084,961 | A | 4/1978 | Caldon | |
| 4,552,589 | A | 11/1985 | Mason et al. | |
| 5,071,477 | A | 12/1991 | Thomas et al. | |
| 2005/0022629 | A1 * | 2/2005 | Ando et al. | 75/419 |
| 2005/0188791 | A1 | 9/2005 | Seeley et al. | |
| 2012/0128528 | A1 * | 5/2012 | Langhans et al. | 420/463 |

FOREIGN PATENT DOCUMENTS

| | | |
|---|---|---|
| CN | 103205567 | 7/2013 |

OTHER PUBLICATIONS

International Search Report for International Patent Application No. PCT/IB2013/002859, mailed Apr. 8, 2014, 4 pages.

Douglas et al., "Magnetic Recovery of Gold-Bearing Iron Oxides at Barrick Goldstrike's Roaster," Paper No. 62, World Gold 2013 Conference, Sep. 26-29, 2013, Queensland, Australia, 12 pages.

* cited by examiner

*Primary Examiner* — Roy King
*Assistant Examiner* — Tima M McGuthry Banks
(74) *Attorney, Agent, or Firm* — Sheridan Ross, P.C.

(57) ABSTRACT

A method to recover gold lost in roaster calcine-leach tailings, due to the formation of cyanide refractory compounds or morphologies during the roasting process. The process can include acid leaching of magnetic concentrate from roaster leach tailings, combining the acid leach slurry to the pre-acidulation tank for pressure oxidation feed, acid pressure oxidation of the pressure oxidation feed, and recovery of gold.

21 Claims, 2 Drawing Sheets

RECOVERY OF GOLD FROM ROASTER CALCINE LEACH TAILINGS

CROSS REFERENCE TO RELATED APPLICATION

The present application claims the benefits of U.S. Provisional Application Ser. Nos. 61/717,405, filed Oct. 23, 2012, and 61/730,860, filed Nov. 28, 2012, both entitled "RECOVERY OF GOLD FROM ROASTER CALCINE LEACH TAILINGS", which is incorporated herein by this reference in its entirety.

FIELD

The disclosure relates generally to precious metal recovery and particularly to recovery of precious metals from roaster calcine-leach tailings.

BACKGROUND

Many of the world's remaining gold deposits are considered to be refractory or double refractory in nature. Refractory ores are those in which the recoveries of gold by conventional cyanidation are typically noneconomic. Many gold ores are sulfide refractory, meaning the gold is inaccessible to gold lixiviants because it occurs as finely disseminated particles within sulfide mineral crystals or as a solid solution in the sulphide matrix. The cost of size reduction associated with liberating this gold is often prohibitive, and, in the case of gold occurring as a solid solution, size reduction is ineffective.

This problem has been overcome by oxidizing the sulfides contained in the ore, thereby liberating the gold from the sulfide matrix and rendering it amenable to leaching by cyanide or other lixiviants. Several methods exist to accomplish oxidation but the two most common are roasting and pressure oxidation. Pressure oxidation can be performed under alkaline conditions, as in the process disclosed by U.S. Pat. No. 4,552,589, or acid conditions, as in the process disclosed by U.S. Pat. No. 5,071,477.

Acid pressure oxidation, or autoclaving, of sulfides in refractory gold ores involves subjecting feed slurry to temperatures of approximately 190° C. to 225° C. in an oxygen atmosphere. If the refractory ore contains carbonate, it must be pre-acidulated to release the $CO_2$ prior to treatment in the autoclave. This is necessary because generation of $CO_2$ within the autoclave will cause increased venting of the autoclave, resulting in the loss of oxygen, and therefore an increase in oxygen consumption, and higher heating costs. Pre-acidification of the autoclave feed is generally performed to maintain the equivalent carbon dioxide levels in the ore to between about 0.1 and about 0.7% by weight.

While not wishing to be bound by any theory, roasting of refractory gold ores converts sulfide sulfur, primarily pyrite, to sulfur dioxide and hematite according to the following equation:

$$4FeS_2+11O_2 \leftrightarrows 2Fe_2O_3+8SO_2$$

Roasting of gold ores is typically performed between 550° C. and 750° C. The temperature of roasting as well as the composition and flow rate of the gaseous phase are optimized according to the mineralogical and/or chemical composition of the gold bearing feed material.

During roasting, an excess of oxygen is required to oxidize pyrite and arsenopyrite to hematite rather than magnetite. Ores containing a high level of calcium carbonate will release $CO_2$, thereby effectively diluting the oxygen content in the gas phase of the roaster and contributing to the formation of magnetite.

In the roaster, a number of highly exothermic reactions can occur when high sulfur and/or arsenide-containing particles react with the oxygen. It is possible that temperature extremes can occur at the molecular level, which may cause fusion to eutectic mixtures of iron oxides and iron sulfides. When these fused particles occlude gold, the recovery of gold in subsequent cyanidation operations will be reduced.

Low roaster temperatures, though reducing pyrite oxidation to hematite, can improve arsenic retention through the formation of pyroarsenate ($2FeO.AS_2O_3$.). Unfortunately, lower roasting temperatures can also cause the formation of low porosity maghemite, which occludes gold particles and reduces the recovery of gold by cyanidation.

Gold can be occluded by both magnetite and maghemite that is formed during the incomplete oxidation of pyrites. Both of these minerals are magnetic, and therefore susceptible to magnetic concentration.

SUMMARY

These and other needs are addressed by the various aspects, embodiments, and configurations of the present disclosure. The present disclosure is directed towards recovering precious metals, particularly gold and silver, from a roasted precious metal-containing feed material.

The process can include the following steps:

(a) optionally roasting a precious metal- and iron-containing material to form a precious metal-containing calcine;

(b) optionally leaching, by a precious metal lixiviant, the precious metal-containing calcine to form a precious metal-containing pregnant leach solution and a precious metal- and iron-containing tails;

(c) magnetically separating a precious metal-containing magnetic concentrate from the precious metal-containing calcine and/or precious metal- and iron-containing tails;

(d) leaching, by a mineral acid, (typically at least a portion and more typically at least most of) the iron from the precious metal-containing magnetic concentrate to form a dissolved iron-containing leach slurry;

(e) contacting the dissolved iron-containing leach slurry with a precious metal- and carbonate-containing material to form an autoclave feed material having a lower carbonate content than the precious metal- and carbonate-containing material; and (f) thereafter recovering the precious metal from the precious metal- and carbonate-containing material.

The precious metal lixiviant can be any precious metal lixiviant including cyanide, thiosulfate, thiourea, and the like. Typically, the precious metal lixiviant dissolves gold and/or other precious metals under alkaline conditions.

The mineral acid can be any suitable mineral acid, with sulfuric acid being preferred.

During mineral acid leaching, the precious metal is typically not leached from the precious metal-containing magnetic concentrate.

The process can recover the gold and/or silver remaining in the calcine carbon-in-leach (CIL) or resin-in-leach (RIL) tails. The method can employ strong acid leaching of the magnetically concentrated precious metal and iron-containing calcine CIL and/or RIL tails, and the leached slurry produced can be used to pre-acidulate an autoclave material. CIP or RIL can remove most of the gold and/or other precious metals from the calcine and magnetic concentration can concentrate iron-occluded gold and/or other precious metals for subsequent dissolution in the mineral acid leach. The mineral acid leached slurry is thereafter contacted with a carbonaceous gold and/or other precious metal-containing (acid pressure oxidation) feed material. The free acids and iron sulfates in the mineral acid leached slurry react with the carbonaceous minerals in the carbonaceous gold and/or other precious metal-containing feed, releasing $CO_2$. This can eliminate the need to neutralize the leach solution and use its contained acid equivalents to release $CO_2$ from the autoclave feed. The autoclave feed can be pressure oxidized, and the gold leached and recovered using conventional methods.

These and other advantages will be apparent from the disclosure of the aspects, embodiments, and configurations contained herein.

"At least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Carbon-in-leach" ("CIL") refers to a recovery process in which a slurry of gold ore, carbon granules and an alkaline lixiviant (e.g., cyanide) are mixed together. The cyanide dissolves the gold content and the gold is absorbed on the carbon. The carbon is subsequently separated from the slurry for further gold removal.

"Carbon-in-pulp" ("CIP") refers to a recovery process, similar to the carbon-in-leach process, in which the slurry is initially subjected to alkaline lixiviant (e.g., cyanide) leaching in separate tanks followed by carbon-in-pulp.

"Means" shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

"Resin-in-leach" ("RIL") refers to a recovery process in which a slurry of gold ore, a particulate gold sorbent (other than carbon granules) and an alkaline lixiviant, particularly cyanide, are mixed together. The cyanide dissolves the gold content and the gold is absorbed on the resin particulates; the particulates are subsequently separated from the slurry for further gold removal.

"Resin-in-pulp" ("RIP") refers to a recovery process, similar to the resin-in-leach process, in which the slurry is initially subjected to alkaline lixiviant (e.g., cyanide) leaching in separate tanks followed by resin-in-pulp.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 1:
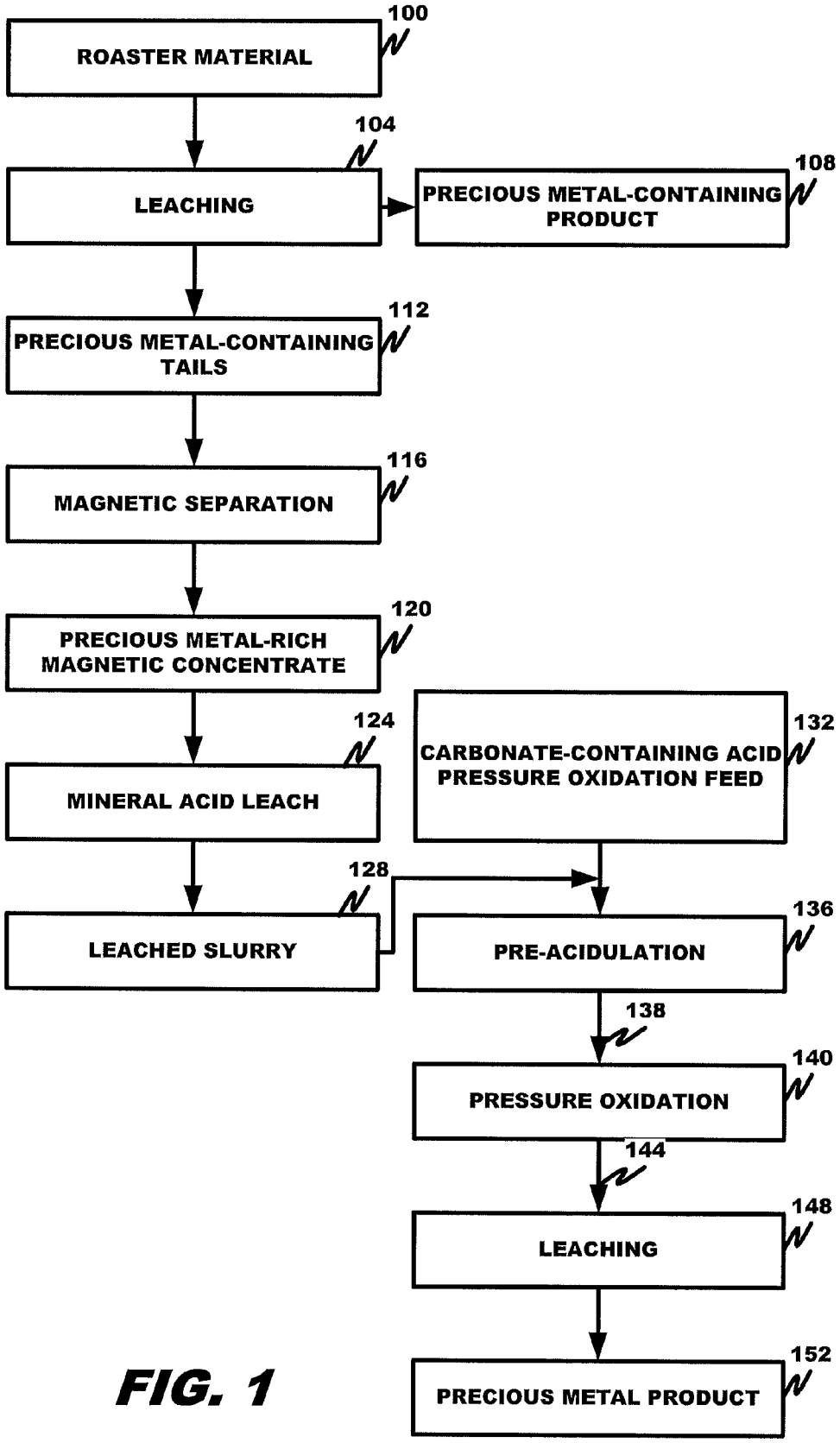
FIG. 1 illustrates a process flow sheet for precious metal recovery from roaster calcined material.

With reference to FIG. 1, a roasted material 100, or calcine, is leached (step 104), such as by CIL, CIP, RIP, or RIL, or other gold and/or other precious metal recovery methods known in the art to produce a precious metal (e.g., gold)-containing product 108 and precious metal (e.g., gold)-containing tails 112. The tails, which contain gold typically in an occluded form, is concentrated using magnetic separation (step 116). The magnetic separation concentrates typically most of the gold and other precious metal(s) that have been occluded by maghemite and/or other iron oxides and other magnetic products formed during the roasting process. The magnetic separation is performed in such a way as to maximize substantially the gold recovery and minimize substantially the mass pull. Generally, the larger the mass pull, the higher is the precious metal recovery and the lower is the concentration of the magnetic component. The optimal grade and recovery in the magnetic concentrate are determined by overall process economics. A low carbonate concentration is favored to reduce subsequent acid consumption; however, a loss in recovery of the gold bound in the magnetic fraction may occur during efforts to decrease carbonate levels in the concentrate. It is desirable to reduce the amount of carbonate within the ore or concentrate to as low a level as possible, without sacrificing precious metal (e.g., gold) recovery, to reduce acid consumption in subsequent steps.

For example, a magnetic concentrate can be formed using a two-stage process employing first a magnetic separator having a 7,000 Gauss field strength that can produce a rougher concentrate typically containing at least about 25%, more typically from about 30 to about 75%, and even more typically about 39.5% of the gold in the precious metal-containing (e.g., calcine) CIL tails with a mass pull of typically no more than about 15%, more typically no more than about 10%, and even more typically no more than about 4%. A subsequent cleaner stage using a second magnetic separator having a 4,000 Gauss field strength can produce a cleaner concentrate typically containing at least about 75%, more typically at least about 80%, and even more typically about 90% of the rougher concentrate's precious metals (e.g., gold) and a mass pull typically of no more than about 70%, more typically of no more than about 65%, and even more typically of about 53%, resulting in an overall recovery for the combined two-stage process typically of at least about 20%, more typically of at least about 25%, and even more typically about 35.6% of the gold and/or other precious metals and an overall mass pull typically of no more than about 10%, more typically of no more than about 5%, and even more typically about 2.1%. Commonly, the carbonate content is no more than about 15 wt. %, more typically no more than about 10 wt. %, and even more commonly no more than about 5%.

Referring again to FIG. 1, the (gold and/or other precious metal-rich) magnetic concentrate 120, is subjected to agitated mineral (e.g., sulfuric) acid leaching (step 124) for about 0.25 to about 3 hours at a leaching temperature of about 80° C. to about 115° C. and at a pulp density of from about 10 to about 40% to form a leach slurry 128. The acid concentration can range from about 100-1400 g/t, however the leaching conditions (e.g., the actual acid strength used to dissolve the iron oxide species, the leaching retention time, and the leaching temperature) are selected to substantially optimize precious metal (e.g., gold) recovery during the subsequent precious metal (e.g., gold) leaching steps. The leached slurry 128 will contain significant free acid and ferric sulfate and solid-phase gold and/or other precious metals. Stated another way, the pH of the leached slurry 128 is typically no more than about pH 5, more typically no more than about pH 4, more typically no more than about pH 3, more typically no more than about pH 2, and even more typically no more than about pH 1. The ferric sulfate content of the leached slurry 128 is determined by the acid required to dissolve the iron and carbonates and other acid consumers in the magnetic concentrate and commonly is at least about 1 g/L, more commonly at least about 5 g/L, and even more commonly at least about 10 g/L.

The leached slurry 128 is then added to the acid pressure oxidation pre-acidulation tank (step 136) where the contained free acid and iron sulfate react with the carbonate minerals in the autoclave feed ore or concentrate 132 to form an acidulated slurry 138 according to the following reactions:

$$(Ca,Mg)CO_3+H_2SO_4 \leftrightarrows (Ca,Mg)SO_4+CO_2+H_2O$$

$$3(Ca,Mg)CO_3+Fe_2(SO_4)_3+3H_2O \leftrightarrows 3(Ca,Mg)SO_4+3CO_2+2Fe(OH)_3$$

$$(Ca,Mg)CO_3+FeSO_4+H_2O \leftrightarrows (Ca,Mg)SO_4+CO_2+Fe(OH)_2$$

The blending ratio of the acid leached slurry 128 to the acid pressure oxidation pre-acidulation tank depends on the acidulation requirement of the carbonate-containing acid pressure oxidation feed 132, which is determined by its carbonate and sulfide content. Typically, the carbonate-to-sulfide ratio required for economic autoclave operation ranges from about 0.5 to about 1.5, more typically from about 0.75 to about 1.25 and even more typically is about 0.9.

Acid pressure oxidation (step 140) is then performed on the blended acidulated feed material at conditions typical of pressure oxidation of gold-bearing ores. The acidulated slurry 138 is preheated to a temperature ranging from about 30° C. to about 115° C. The acidulated material in the acidulated slurry 138 is subjected to pressure oxidation to oxidize the sulfide sulfur. Acid pressure oxidation is typically performed at a temperature ranging from about 170 to about 240° C. During acid pressure oxidation, sufficient molecular oxygen is introduced into the autoclave to maintain a partial pressure commonly ranging from about 20 to about 300 psig. The total pressure in the acid autoclave commonly ranges from about 250 to about 750 psig. The duration of acid pressure oxidation depends upon the mineral characteristics of the autoclave feed material (or acidulated slurry 138), the pressure oxidation temperature and pressure, particle size, and free acid levels. Preferably, the pressure oxidation retention time ranges from about 0.5 to about 3 hours.

While not wishing to be bound by any theory, the ferrous hydroxide and ferric hydroxide formed in the pressure oxidation pre-acidulation tank (step 136) will dissolve and re-precipitate as hematite during acid pressure oxidation (step 140) according to the following reaction:

$$2Fe(OH)_2+2H_2SO_4 \leftrightarrows 2FeSO_4+4H_2O$$

$$2FeSO_4+0.5O_2+H_2O \leftrightarrows Fe_2O_3+2H_2SO_4$$

$$2Fe(OH)_3+3H_2SO_4 \leftrightarrows Fe_2(SO_4)_3+6H_2O$$

$$Fe_2(SO_4)_3+3H_2O \leftrightarrows Fe_2O_3+3H_2SO_4$$

The solution phase of the acid autoclave discharge slurry 144 commonly contains from about 2 to about 150 g/L (iron) sulfate sulfur and from about 5 and about 25 g/L free sulfuric acid and a residue containing the gold and/or other precious metals. The residue is derived from the solid phase of the leached slurry and the carbonate-containing acid pressure oxidation feed 132.

The autoclave discharge slurry is then neutralized using a combination of lime and limestone, and the pH is adjusted, commonly to greater than pH 10.5. Typically, gold and/or other precious metals is/are leached (step 148) from the alkaline slurry using cyanide and recovered using Carbon-in-leach (CIL) or Carbon-in-pulp (CIP) techniques to form a precious metal (e.g., gold) product 152. Other gold leaching and recovery techniques known in the art could also be employed, such as RIL or RIP.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

Example 1

Gold Recovery of Roaster-Carbon in Leach Tails

A sample of magnetic cleaner concentrate of roaster calcine-CIL tails containing 12.4 g/t gold, 33.8% iron (Fe) (typically in the form of iron oxides), and 3.4% carbonate ($CO_3$), was subjected to gold recovery by carbon-in-leach. Carbon-in-leach was conducted at 30% solids, 1 g/L sodium cyanide (NaCN) at pH 10.5 at ambient temperature for 6 hours. The recovery of gold was only 2.3%, indicating that the gold in the sample is highly refractory in nature.

Example 2

The Effect of Acidification on Gold Recovery on Roaster-Carbon in Leach Tails A sample of magnetic cleaner concentrate of roaster calcine-CIL tails containing 12.4 g/t gold, 33.8% Fe (typically in the form of iron oxides), and 3.4% $CO_3$, was sulfuric acid leached with agitation for a period of 3 hours at 95° C. at a pulp density of 40%. The amount of acid added was 100 to 1300 kg/t of concentrate. After leaching, the solution was sampled for free acid and ferrous iron. The leached slurry was filtered, and the solids washed, and then one-half of the sample was re-pulped with water at 30% solids, and the gold in the solids was recovered using the conditions outlined in example 1. The second half of the washed and filtered solids in the leached slurry was employed in Example 3.

| Acid Addition | Solution Analysis | | | Elemental Dissolution | | Gold Recovery |
|---|---|---|---|---|---|---|
| kg/t conc. | Fe g/L | $Fe2^+$ g/L | $H_2SO_4$ g/L | Fe % | As % | % Au |
| 100 | 6.3 | 6.3 | <0.1 | 2.9 | 0.4 | 6.9 |
| 400 | 72.68 | 11.0 | 18 | 37.0 | 66.2 | 32.0 |
| 700 | 102.5 | 10.6 | 74 | 57.1 | 88.7 | 61.3 |
| 1000 | 122.7 | 9.9 | 146 | 73.2 | 96.1 | 70.5 |
| 1300 | 134.4 | 8.4 | 188 | 86.8 | 91.1 | 75.5 |

The above table demonstrates that as sulfuric acid strength increases, the more complete is the dissolution of iron compounds. The dissolution of the iron compounds renders the contained gold more accessible to gold lixiviants, thereby increasing the gold recovery. The advent of sulfuric acid leaching has increased the recovery of gold by up to 73% over cyanidation alone.

The highest gold recoveries are observed at the highest acid strengths. Use of a strong acid produces a leached slurry high in dissolved iron and free acid.

Example 3

The Effect of Acidification and Pressure Oxidation on Gold Recovery on Roaster-Carbon in Leach Tails The second half of the acid leached solids generated in Example 2 was re-pulped at 40% solids (30% solids for 1300 kg/t residue), and the pH was adjusted to pH 1.5 with sulfuric acid (if required). The slurry was acid pressure oxidized in a 2 L autoclave at 225° C., with an oxygen over pressure of 100 psi for one hour. Once acid pressure oxidation was competed, solution and solid samples were taken for analysis. The remaining slurry was neutralized and re-pulped with water at 30% solids, and the gold was recovered using the conditions outlined in example 1.

Figure 2:
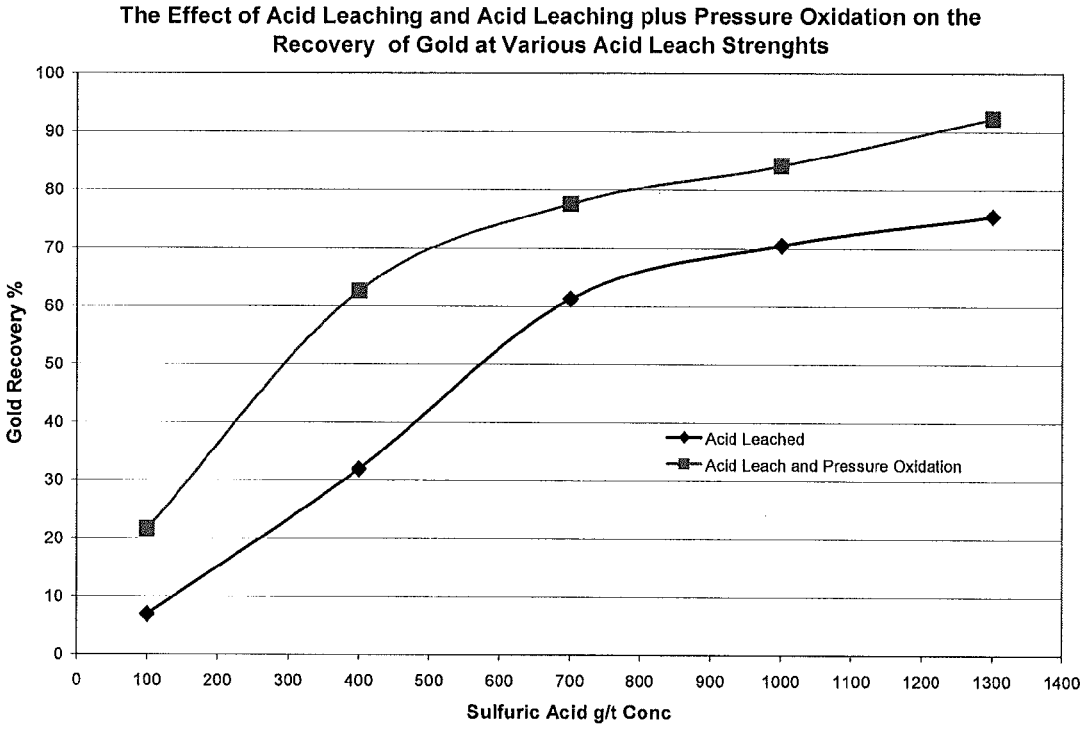
FIG. 2 is a plot of gold recovery (%) (vertical axis) against sulfuric acid concentration (g/t) (horizontal axis).

With reference to FIG. 2, the above tests demonstrate that, at a given acid concentration, approximately 12-15% more gold is recovered when acid leaching was followed by acid pressure oxidation.

Example 4

Over All Acid Consumption in the Acid Leaching, Pre-Acidulation Acid Pressure Oxidation The magnetic cleaner concentrate from roaster calcine-CIL tailings employed in the above examples contained 12.4 g/t gold, 33.8% Fe (typically in the form of iron oxides), 3.4% $CO_3$, 0.9% magnesium (Mg) (typically as an oxide or carbonate), and 1.6% aluminum (Al). It has been illustrated that the higher the dissolution of iron the greater is the gold recovery. The stoichiometric sulfuric acid requirement for the complete destruction of the carbonate content and dissolution of the iron oxides is 55 kg/t and 889 kg/t, respectively, or 944 kg/t in total. This represents a significant acid demand, and the test results indicate that a greater than stoichiometric amount is required to achieve high gold recovery. Aluminum and other components present in the concentrate will also consume acid.

High acid strengths employed during leaching resulted in high iron and acid levels in the terminal leach solution. To recover gold directly from the acid leached residue, a liquid/solid separation step and probable washing step would be required. The solution phase of the acid leached slurry containing high levels of iron and sulfuric acid would likely require neutralization. This neutralization can be costly.

While not wishing to be bound by any theory, when the acid leached slurry is added to the pre-acidulation tank of an acid pressure oxidation tank, the following reactions are believed to occur:

$$(Ca,Mg)CO_3+H_2SO_4 \leftrightarrows (Ca,Mg)SO_4+CO_2+H_2O$$

$$3(Ca,Mg)CO_3+Fe_2(SO_4)_3+3H_2O \leftrightarrows 3(Ca,Mg)SO_4+3CO_2+2Fe(OH)_3$$

$$(Ca,Mg)CO_3+FeSO_4+H_2O \leftrightarrows (Ca,Mg)SO_4+CO_2+Fe(OH)_2$$

The addition of the acid leached slurry will reduce or eliminate the need to add fresh acid to the acid pressure oxidation pre-acidulation tank.

While not wishing to be bound by any theory, the ferrous hydroxide and ferric hydroxide formed in the pressure oxidation pre-acidulation tank will dissolve and re-precipitate as hematite during acid pressure oxidation in accordance with the following reaction(s):

$$2Fe(OH)_2+2H_2SO_4 \leftrightarrows 2FeSO_4+4H_2O$$

$$2FeSO_4+0.5O_2+H_2O \leftrightarrows Fe_2O_3+2H_2SO_4$$

$$2Fe(OH)_3+3H_2SO_4 \leftrightarrows Fe_2(SO_4)_3+6H_2O$$

$$Fe_2(SO_4)_3+3H_2O \leftrightarrows Fe_2O_3+3H_2SO_4$$

The pre-acidulation and acid pressure oxidation steps therefore consume the free acid and precipitate the iron from the acid leached slurry.

It is estimated that, when the acid leach treatment is integrated with the pre-acidulation of pressure oxidation feed, the total acid requirements are reduced from 944 kg/t concentrate to 100 kg/t.

A number of variations and modifications of the disclosure can be used. It would be possible to provide for some features of the disclosure without providing others.

For example in one alternative embodiment, the process is used to recover silver from roasted material, such as carbon-in-leach ("CIL") tailings.

In another alternative embodiment, the process is used to recover precious metals from other types of roasted material, including resin-in-leach calcine and calcine leached by other processes.

In another alternative embodiment, the process can be done using mineral acids other than sulfuric acid.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure. Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A process, comprising:

magnetically separating an iron-containing magnetic concentrate from an iron-containing material;

leaching, by a mineral acid, iron from the iron-containing magnetic concentrate to form a dissolved iron-containing leach slurry;

contacting at least a portion of the dissolved iron-containing leach slurry with a precious metal- and carbonate-containing material; and thereafter recovering the precious metal from the precious metal- and carbonate-containing material.

2. The process of claim 1, wherein the iron-containing magnetic concentrate and material each contain a precious metal and further comprising:

roasting a precious metal- and iron-containing feed material to form a precious metal-containing calcine; and leaching, by a precious metal lixiviant, the precious metal-containing calcine to form a precious metal-containing fraction containing most of the precious metal in the precious metal-containing calcine and the precious metal- and iron-containing material.

3. The process of claim 2, wherein the precious metal-containing magnetic concentrate comprises at least about 20 wt % of the gold in the precious metal- and iron-containing material.

4. The process of claim 3, wherein the precious metal-containing magnetic concentrate comprises at least about 25 wt % of the gold in the precious metal- and iron-containing material.

5. The process of claim 3, wherein a mass pull of the magnetic separation step is no more than about 10 wt %.

6. The process of claim 5, wherein the mass pull is no more than about 5 wt %.

7. The process of claim 1, wherein a combined feed material is formed by the contacting of the dissolved iron-containing leach slurry with a precious metal- and carbonate-containing material and wherein the combined feed material has a lower carbonate content than the precious metal- and carbonate-containing material.

8. The process of claim 7, wherein the iron-containing magnetic concentrate and material each contain a precious metal, wherein the precious metal-containing fraction is one of a pregnant leach solution and a precious metal-containing sorbent, wherein the combined feed material comprises sulfidic sulfur, and wherein the thereafter recovering comprises:

pressure oxidizing the combined feed material to convert at least most of the sulfides in the combined feed material to sulfates and form a pressure oxidation residue comprising at least most of the precious metal in the combined feed material and an acidic fraction;

separating at least most of the residue from the acidic fraction;

contacting the separated residue with a base to consume at least most of any acid and acid equivalents in the residue and form an acid neutralized residue; and alkaline leaching at least most of the precious metal from the acid neutralized residue.

9. The process of claim 8, wherein the precious metal is gold.

10. The process of claim 1, wherein at least most of the iron is leached by the mineral acid.

11. The process of claim 1, wherein the mineral acid leaching step is performed at a pH of no more than about pH 5, a mineral acid concentration of from about 100 to about 1,400 g/t, and a temperature of about 80 to about 115° C.

12. The process of claim 11, wherein the pH is no more than about pH 2.

13. The process of claim 1, wherein, in the contacting step, a carbonate-to-sulfide weight ratio in the combined autoclave feed material is from about 0.5 to about 1.5.

14. The process of claim 13, wherein the carbonate-to-sulfide weight ratio is from about 0.75 to about 1.25.

15. A process, comprising:

roasting a precious metal- and iron-containing material to form a precious metal- and iron-containing calcine;

magnetically separating a precious metal-rich and iron-containing magnetic concentrate from the precious metal- and iron-containing calcine;

leaching, by a mineral acid, iron from the precious metal-rich and iron-containing magnetic concentrate to form a dissolved iron-containing leach slurry;

contacting the dissolved iron-containing leach slurry with a precious metal- and carbonate-containing material to react with at least a portion of the carbonate and form a combined feed material having a lower carbonate content than the precious metal- and carbonate-containing material; and thereafter recovering the precious metal from the precious metal- and carbonate-containing material.

16. The process of claim 15, further comprising leaching, by a precious metal lixiviant, the precious metal- and iron-containing containing calcine to form a precious metal-containing fraction and a precious metal- and iron-containing tails; and separating the precious metal-containing fraction from the precious metal- and iron-containing tails, wherein the precious metal-rich and iron-containing concentrate is magnetically separated from the precious metal- and iron-containing tails.

17. The process of claim 16, wherein magnetic separation removes at least a portion of the iron from the precious metal- and iron-containing tails, the removed at least a portion of the iron being in the precious metal-rich and iron-containing magnetic concentrate.

18. The process of claim 16, wherein the precious metal-containing fraction is one of a pregnant leach solution and a precious metal-containing sorbent, wherein the combined feed material comprises sulfidic sulfur, and wherein the thereafter recovering comprises:

pressure oxidizing the combined feed material to convert at least most of the sulfides in the combined feed material to sulfates and form a pressure oxidation residue comprising at least most of the precious metal in the combined feed material and an acidic fraction;

separating at least most of the residue from the acidic fraction;

contacting the separated residue with a base to consume at least most of any acid and acid equivalents in the residue and form an acid neutralized residue; and alkaline leaching at least most of the precious metal from the acid neutralized residue.

19. The process of claim 15, wherein the precious metal is gold.

20. The process of claim 15, wherein at least most of the iron is leached by the mineral acid.

21. A process, comprising:

roasting a precious metal- and iron-containing material to form a precious metal-containing calcine;

leaching, by a precious metal lixiviant, the precious metal-containing calcine to form a precious metal-containing pregnant leach solution and a precious metal- and iron-containing tails;

magnetically separating a precious metal- and iron-containing magnetic concentrate from the precious metal- and iron-containing tails;

leaching, by a mineral acid, iron from the precious metal- and iron-containing magnetic concentrate to form a dissolved iron-containing leach slurry, wherein the iron-containing leach slurry contains iron sulfate and free sulfuric acid;

contacting the dissolved iron-containing leach slurry with a precious metal- and carbonate-containing material to form a combined autoclave feed material having a lower carbonate content than the precious metal- and carbonate-containing material;

oxidizing the combined autoclave feed material in an autoclave; and thereafter recovering the precious metal from the precious metal- and carbonate-containing material.

* * * * *